US008561698B2

(12) United States Patent
Harrigan et al.

(10) Patent No.: US 8,561,698 B2
(45) Date of Patent: Oct. 22, 2013

(54) DOWNHOLE FLUID INJECTION

(75) Inventors: Edward Harrigan, Richmond, TX (US); Douglas W. Grant, Cedar Creek, TX (US); Nathan Church, Missouri City, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 324 days.

(21) Appl. No.: 12/815,008

(22) Filed: Jun. 14, 2010

(65) Prior Publication Data

US 2011/0303409 A1 Dec. 15, 2011

(51) Int. Cl.
*E21B 47/00* (2012.01)

(52) U.S. Cl.
USPC ..... 166/264; 166/266; 166/401; 166/305.1; 175/59

(58) Field of Classification Search
USPC ..... 166/264, 266, 401, 305.1; 175/50–53, 175/58–59, 314; 73/152.26, 152.17
See application file for complete search history.

(56) References Cited

U.S. PATENT DOCUMENTS

| | | | | |
|---|---|---|---|---|
| 6,641,434 | B2 | 11/2003 | Boyle et al. | |
| 7,114,562 | B2 | 10/2006 | Fisseler et al. | |
| 7,367,394 | B2 * | 5/2008 | Villareal et al. | 166/264 |
| 7,528,600 | B2 | 5/2009 | Sen et al. | |
| 7,614,294 | B2 | 11/2009 | Hegeman et al. | |
| 7,746,069 | B2 | 6/2010 | Johansen et al. | |
| 2006/0054323 | A1 * | 3/2006 | Grant et al. | 166/305.1 |
| 2009/0255669 | A1 | 10/2009 | Ayan et al. | |
| 2010/0126717 | A1 | 5/2010 | Kuchuk et al. | |
| 2010/0264915 | A1 | 10/2010 | Saldungaray et al. | |

* cited by examiner

*Primary Examiner* — Yong-Suk (Philip) Ro
(74) *Attorney, Agent, or Firm* — John Vereb; Cathy Hewitt

(57) ABSTRACT

Downhole tools and methods are provided for injecting fluid into a formation. A downhole tool may include a first chamber of injection fluid separated from a second chamber of working fluid by a piston. The working fluid may be employed to apply pressure to the piston to direct injection fluid from the first chamber to the formation. A flow regulator may regulate flow of the injection fluid from the first chamber to the formation.

16 Claims, 14 Drawing Sheets

DOWNHOLE FLUID INJECTION

BACKGROUND OF THE DISCLOSURE

Wells are generally drilled into the ground or ocean bed to recover natural deposits of oil and gas, as well as other desirable materials that are trapped in geological formations in the Earth's crust. Wells are typically drilled using a drill bit attached to the lower end of a "drill string." Drilling fluid, or mud, is typically pumped down through the drill string to the drill bit. The drilling fluid lubricates and cools the bit, and may additionally carry drill cuttings from the wellbore back to the surface.

In various oil and gas exploration operations, it may be beneficial to have information about the subterranean formations that are penetrated by a wellbore. For example, certain formation evaluation schemes may include measurement and analysis of the formation pressure and permeability. These measurements may be essential to predicting the production capacity and production lifetime of the subterranean formation. In some implementations, pump systems may be used to draw and pump formation fluid from subterranean formations. In some implementations, pump systems may be used to pump injection fluid from a downhole tool into the subterranean formations. A downhole string (e.g., a drill string, coiled tubing, slickline, wireline, etc.) may include one or more pump systems depending on the operations to be performed using the downhole string.

Log-inject-log programs may be used to test the formation. A formation tester may include a sample chamber loaded with injection fluid. A first measurement may be made of the subterranean formation, and then the injection fluid may be injected into the subterranean formation. For example, the injection fluid may be injected into the subterranean formation so as to replace the in-situ fluids. After the injection, a second measurement of the subterranean formation may be made. Flow control may be desired when injecting fluids into the subterranean formation between measurements. However, traditional pump systems may be limited in operation by the range of flow rates that may be achieved during injection, or may be limited by the ability to control the flow rates that may be achieved during injection.

BRIEF DESCRIPTION OF THE DRAWINGS

The present disclosure is best understood from the following detailed description when read with the accompanying figures. It is emphasized that, in accordance with the standard practice in the industry, various features are not drawn to scale. In fact, the dimensions of the various features may be arbitrarily increased or reduced for clarity of discussion.

DETAILED DESCRIPTION

Figure 1:
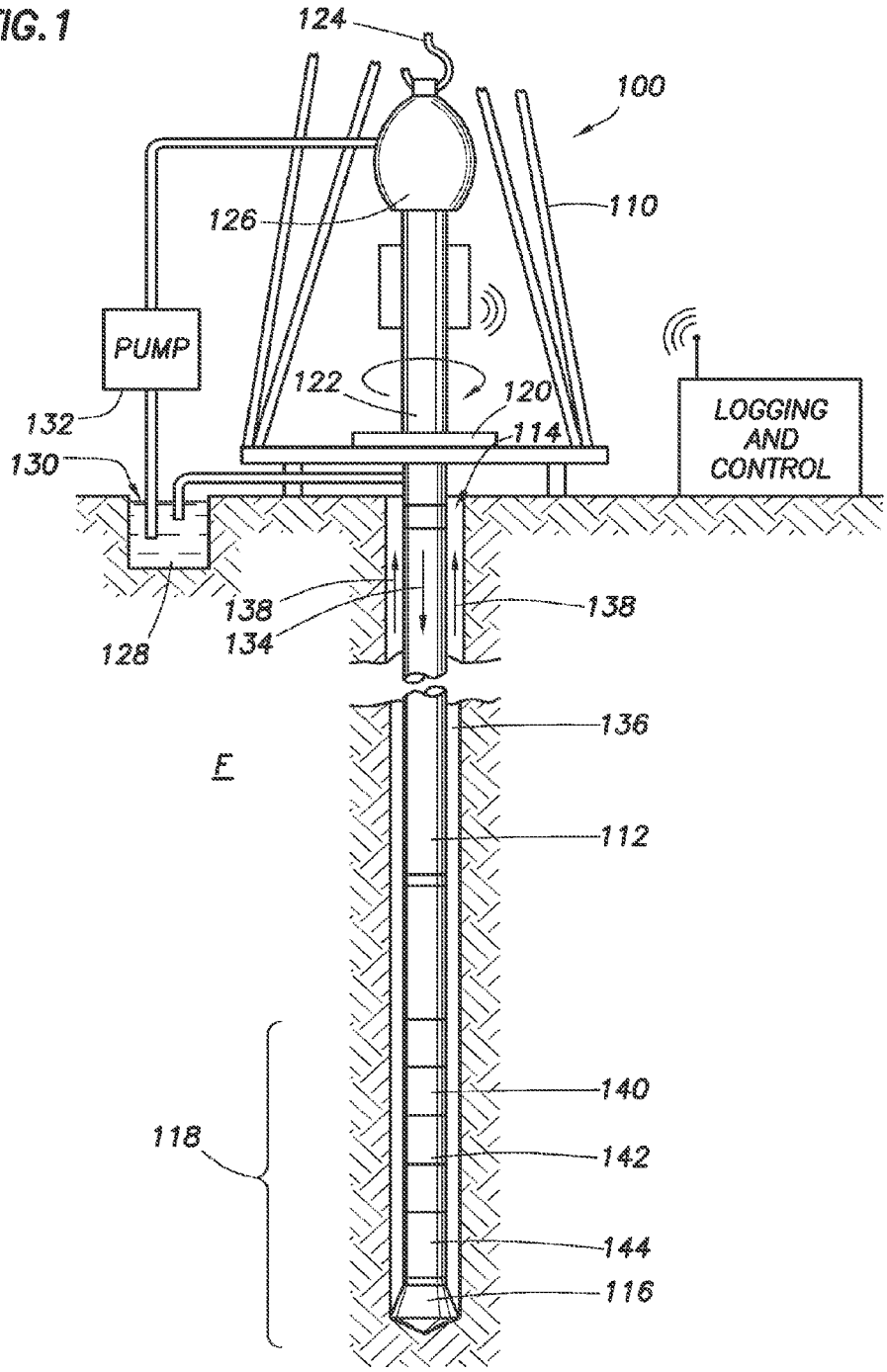
FIG. 1 is a schematic view of apparatus according to one or more aspects of the present disclosure.

It is to be understood that the following disclosure provides many different embodiments, or examples, for implementing different features of various embodiments. Specific examples of components and arrangements are described below to simplify the present disclosure. These are, of course, merely examples and are not intended to be limiting. In addition, the present disclosure may repeat reference numerals and/or letters in the various examples. This repetition is for the purpose of simplicity and clarity and does not in itself dictate a relationship between the various embodiments and/or configurations discussed. Moreover, the formation of a first feature over or on a second feature in the description that follows may include embodiments in which the first and second features are formed in direct contact, and may also include embodiments in which additional features may be formed interposing the first and second features, such that the first and second features may not be in direct contact.

Referring to FIG. 1, illustrated is a schematic view of a wellsite 100 having a drilling rig 110 with a drill string 112 suspended therefrom in accordance with one or more aspects of the present disclosure. The wellsite 100 shown, or one similar thereto, may be used within onshore and/or offshore locations. In this embodiment, a wellbore 114 may be formed within a subterranean formation F, such as by using rotary drilling, or any other method known in the art. As such, one or more embodiments in accordance with the present disclosure may be used within a wellsite, similar to the one as shown in FIG. 1 (discussed more below). Those having ordinary skill in the art will appreciate that the present disclosure may be used within other wellsites or drilling operations, such as within a directional drilling application, without departing from the scope of the present disclosure.

Continuing with FIG. 1, the drill string 112 may suspend from the drilling rig 110 into the wellbore 114. The drill string 112 may include a bottom hole assembly 118 and a drill bit 116, in which the drill bit 116 may be disposed at an end of the drill string 112. The surface of the wellsite 100 may have the drilling rig 110 positioned over the wellbore 114, and the drilling rig 110 may include a rotary table 120, a kelly 122, a traveling block or hook 124, and may additionally include a rotary swivel 126. The rotary swivel 126 may be suspended from the drilling rig 110 through the hook 124, and the kelly 122 may be connected to the rotary swivel 126 such that the kelly 122 may rotate with respect to the rotary swivel.

An upper end of the drill string 112 may be connected to the kelly 122, such as by threadingly connecting the drill string 112 to the kelly 122, and the rotary table 120 may rotate the kelly 122, thereby rotating the drill string 112 connected thereto. As such, the drill string 112 may be able to rotate with respect to the hook 124. Those having ordinary skill in the art, however, will appreciate that though a rotary drilling system is shown in FIG. 1, other drilling systems may be used without departing from the scope of the present disclosure. For example, a top-drive (also known as a "power swivel") system may be used without departing from the scope of the present disclosure. In such a top-drive system, the hook 124, swivel 126, and kelly 122 are replaced by a drive motor (electric or hydraulic) that may apply rotary torque and axial load directly to drill string 112.

The wellsite 100 may include drilling fluid 128 (also known as drilling "mud") stored in a pit 130. The pit 130 may be formed adjacent to the wellsite 100, as shown, in which a pump 132 may be used to pump the drilling fluid 128 into the wellbore 114. The pump 132 may pump and deliver the drilling fluid 128 into and through a port of the rotary swivel 126, thereby enabling the drilling fluid 128 to flow into and downwardly through the drill string 112, the flow of the drilling fluid 128 indicated generally by direction arrow 134. This drilling fluid 128 may then exit the drill string 112 through one or more ports disposed within and/or fluidly connected to the drill string 112. For example, the drilling fluid 128 may exit the drill string 112 through one or more ports formed within the drill bit 116.

As such, the drilling fluid 128 may flow back upwardly through the wellbore 114, such as through an annulus 136 formed between the exterior of the drill string 112 and the interior of the wellbore 114, the flow of the drilling fluid 128 indicated generally by direction arrow 138. With the drilling fluid 128 following the flow pattern of direction arrows 134 and 138, the drilling fluid 128 may be able to lubricate the drill string 112 and the drill bit 116, and/or may be able to carry formation cuttings formed by the drill bit 116 (or formed by any other drilling components disposed within the wellbore 114) back to the surface of the wellsite 100. As such, this drilling fluid 128 may be filtered and cleaned and/or returned back to the pit 130 for recirculation within the wellbore 114.

Though not shown, the drill string 112 may include one or more stabilizing collars. A stabilizing collar may be disposed within and/or connected to the drill string 112, in which the stabilizing collar may be used to engage and apply a force against the wall of the wellbore 114. This may enable the stabilizing collar to prevent the drill string 112 from deviating from the desired direction for the wellbore 114. For example, during drilling, the drill string 112 may "wobble" within the wellbore 114, thereby enabling the drill string 112 to deviate from the desired direction of the wellbore 114. This wobble may also be detrimental to the drill string 112, components disposed therein, and the drill bit 116 connected thereto. However, a stabilizing collar may be used to minimize, if not overcome altogether, the wobble action of the drill string 112, thereby possibly increasing the efficiency of the drilling performed at the wellsite 100 and/or increasing the overall life of the components at the wellsite 100.

As discussed above, the drill string 112 may include a bottom hole assembly 118, such as by having the bottom hole assembly 118 disposed adjacent to the drill bit 116 within the drill string 112. The bottom hole assembly 118 may include one or more components included therein, such as components to measure, process, and/or store information. The bottom hole assembly 118 may include components to communicate and/or relay information to the surface of the wellsite.

As such, as shown in FIG. 1, the bottom hole assembly 118 may include one or more logging-while-drilling ("LWD") tools 140 and/or one or more measuring-while-drilling ("MWD") tools 142. The bottom hole assembly 118 may also include a steering-while-drilling system (e.g., a rotary-steerable system) and motor 144, in which the rotary-steerable system and motor 144 may be coupled to the drill bit 116.

The LWD tool 140 shown in FIG. 1 may include a thick-walled housing, commonly referred to as a drill collar, and may include one or more of a number of logging tools known in the art. Thus, the LWD tool 140 may be capable of measuring, processing, and/or storing information therein, as well as capabilities for communicating with equipment disposed at the surface of the wellsite 100.

The MWD tool 142 may also include a housing (e.g., drill collar), and may include one or more of a number of measuring tools known in the art, such as tools used to measure characteristics of the drill string 112 and/or the drill bit 116. The MWD tool 142 may also include an apparatus for generating and distributing power within the bottom hole assembly 118. For example, a mud turbine generator powered by flowing drilling fluid therethrough may be disposed within the MWD tool 142. Alternatively, other power generating sources and/or power storing sources (e.g., a battery) may be disposed within the MWD tool 142 to provide power within the bottom hole assembly 118. As such, the MWD tool 142 may include one or more of the following measuring tools: a weight-on-bit measuring device, a torque measuring device, a vibration measuring device, a shock measuring device, a stick slip measuring device, a direction measuring device, an inclination measuring device, and/or any other device known in the art used within an MWD tool.

According to one or more aspects of the present disclosure, the LWD tool 140 may comprise a carrier module having a sample chamber for conveying an injection fluid into the wellbore 114. A piston may be disposed in the sample chamber, the piston defining a first chamber and a second chamber within the sample chamber. The sample chamber may comprise a first fluid port fluidly coupled to the first chamber, and a second fluid port fluidly coupled to the second chamber. The carrier module may comprise a flow regulator fluidly coupled to at least one of the first fluid port and the second fluid port. The LWD tool 140 may be used to inject fluid from the sample chamber into the formation F as described herein.

Figure 2:
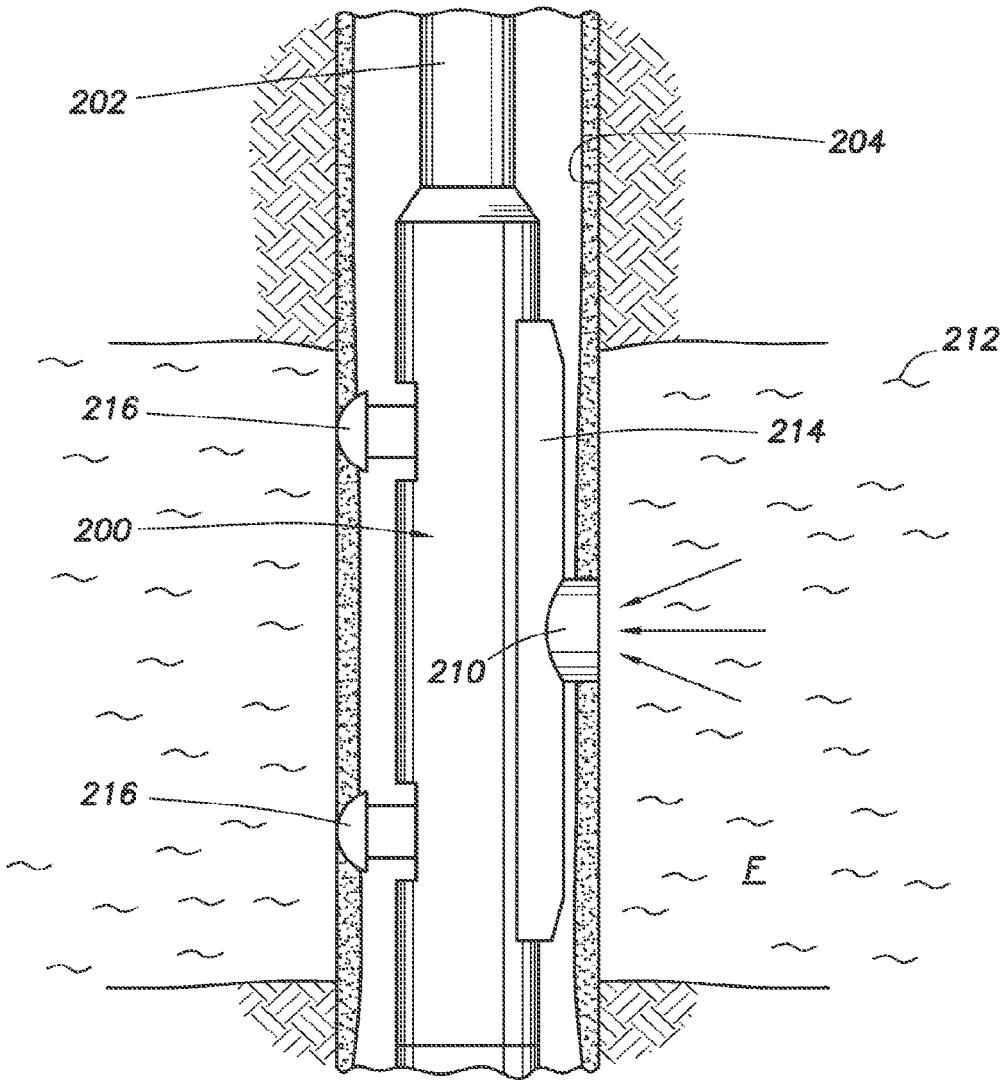
FIG. 2 is a schematic view of apparatus according to one or more aspects of the present disclosure.

Referring to FIG. 2, illustrated is a schematic view of a tool 200 in accordance with one or more aspects of the present disclosure. The tool 200 may be connected to and/or included within a drill string 202, in which the tool 200 may be disposed within a wellbore 204 formed within a subterranean formation F. As such, the tool 200 may be included and used within a bottom hole assembly, as described above.

Particularly, the tool 200 may include a sampling-while drilling ("SWD") tool, such as that described within U.S. Pat. No. 7,114,562, filed on Nov. 24, 2003, entitled "Apparatus and Method for Acquiring Information While Drilling," and incorporated herein by reference in its entirety. As such, the tool 200 may include a probe 210 to hydraulically establish communication with the subterranean formation F and draw formation fluid 212 into the tool 200.

The tool 200 may also include a stabilizer blade 214 and/or one or more pistons 216. As such, the probe 210 may be disposed on the stabilizer blade 214 and extend therefrom to engage the wall of the wellbore 204. The pistons, if present, may also extend from the tool 200 to assist probe 210 in engaging with the wall of the wellbore 204. Alternatively, though, the probe 210 may not necessarily engage the wall of the wellbore 204 when drawing fluid.

As such, fluid 212 drawn into the tool 200 may be measured to determine one or more parameters of the subterranean formation F, such as pressure and/or pretest parameters of the subterranean formation F. Additionally, the tool 200 may include one or more devices, such as sample chambers or sample bottles, which may be used to collect formation fluid samples. These formation fluid samples may be retrieved back at the surface with the tool 200. Alternatively, rather than collecting formation fluid samples, the formation fluid 212 received within the tool 200 may be circulated back out into the subterranean formation F and/or wellbore 204. As such, a pumping system may be included within the tool 200 to pump the formation fluid 212 circulating within the tool 200. For example, the pumping system may be used to pump formation fluid 212 from the probe 210 to the sample bottles and/or back into the formation F.

According to one or more aspects of the present disclosure, the tool 200 may be used to inject fluid through the probe 210 and into the formation F as described herein. As such, the tool 200 may comprise a carrier module having a sample chamber for conveying an injection fluid into the wellbore 204. A piston may be disposed in the sample chamber, the piston defining a first chamber and a second chamber within the sample chamber. The sample chamber may comprise a first fluid port fluidly coupled to the first chamber, and a second fluid port fluidly coupled to the second chamber. The carrier module may comprise a flow regulator fluidly coupled to at least one of the first fluid port and the second fluid port.

Figure 3:
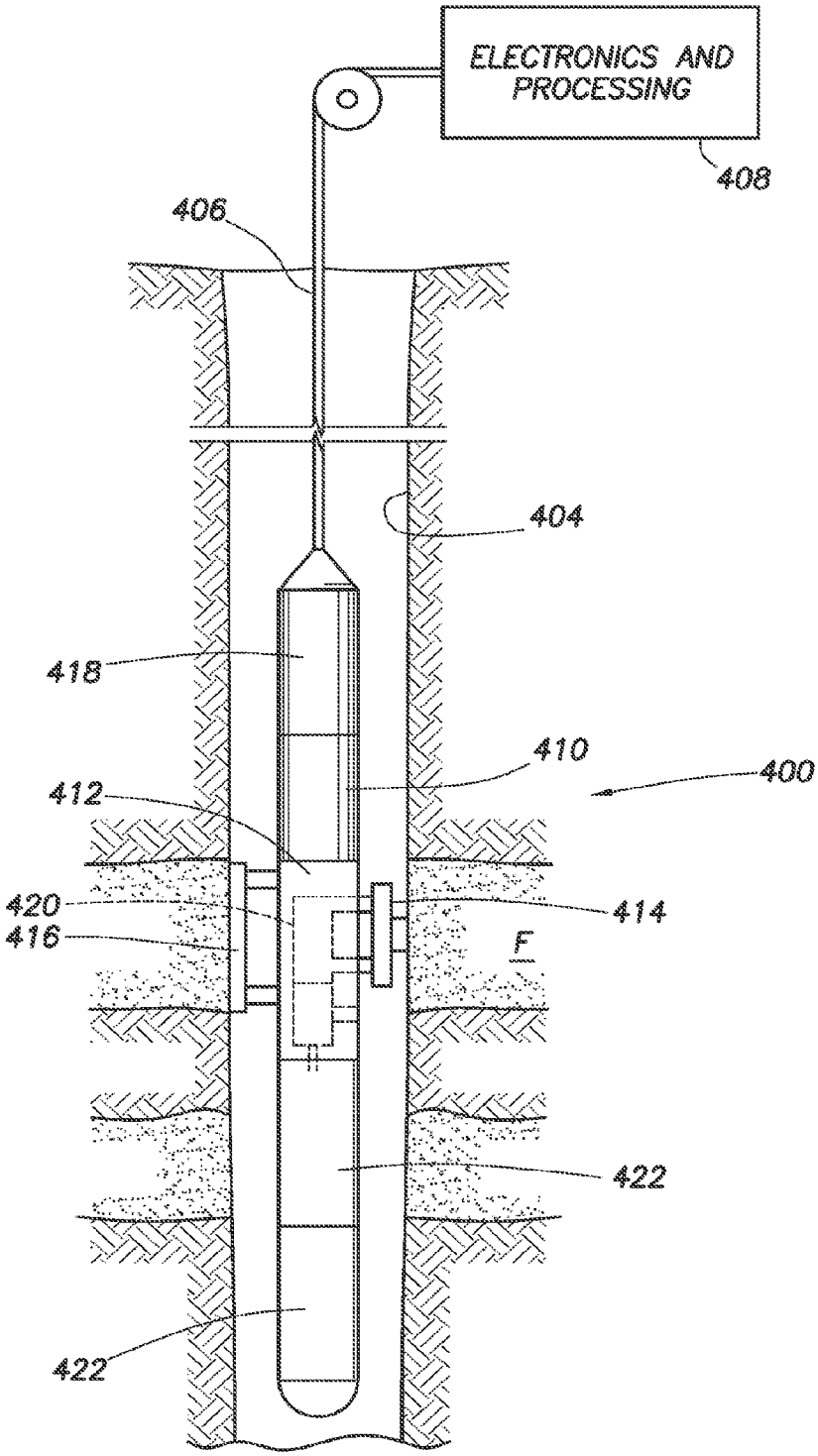
FIG. 3 is a schematic view of apparatus according to one or more aspects of the present disclosure.

Referring to FIG. 3, illustrated is a schematic view of a wellsite having a tool 400 in accordance with one or more aspects of the present disclosure. The tool 400 may be a "wireline" tool, in which the tool 400 may be suspended within a wellbore 404 formed within a subterranean formation F. As such, the tool 400 may be suspended from an end of a multi-conductor cable 406 located at the surface of the formation F, such as by having the multi-conductor cable 406 spooled around a winch (not shown) disposed in a logging truck (not shown) located at the surface of the formation F. The multi-conductor cable 406 is then coupled the tool 400 with an electronics and processing system 408 disposed on the surface.

The tool 400 may have an elongated body 410 that includes a formation tester 412 disposed therein. The formation tester 412 may include an extendable probe 414 and an extendable anchoring member 416, in which the probe 414 and anchoring member 416 may be disposed on opposite sides of the body 410. One or more other components 418, such as a measuring device, may also be included within the tool 400.

The probe 414 may be included within the tool 400 such that the probe 414 may be able to extend from the body 410 and then selectively seal off and/or isolate selected portions of the wall of the wellbore 404. This may enable the probe 414 to establish pressure and/or fluid communication with the formation F to draw fluid samples from the formation F. The tool 400 may also include a fluid analysis tester 420 that is in fluid communication with the probe 414, thereby enabling the fluid analysis tester 420 to measure one or more properties of the fluid. The fluid from the probe 414 may also be sent to one or more sample chambers and/or bottles 422, which may receive and/or retain fluids obtained from the formation F for subsequent testing after being received at the surface. The fluid from the probe 414 may also be sent back out into the wellbore 404 or formation F.

According to one or more aspects of the present disclosure, the tool 400 may be used to inject fluid through the probe 414 and into the formation F as described herein. As such, the tool 400 may comprise a carrier module having a sample chamber for conveying an injection fluid into the wellbore 404. A piston may be disposed in the sample chamber, the piston defining a first chamber and a second chamber within the sample chamber. The sample chamber may comprise a first fluid port fluidly coupled to the first chamber, and a second fluid port fluidly coupled to the second chamber. The carrier module may comprise a flow regulator fluidly coupled to at least one of the first fluid port and the second fluid port.

Figure 4:
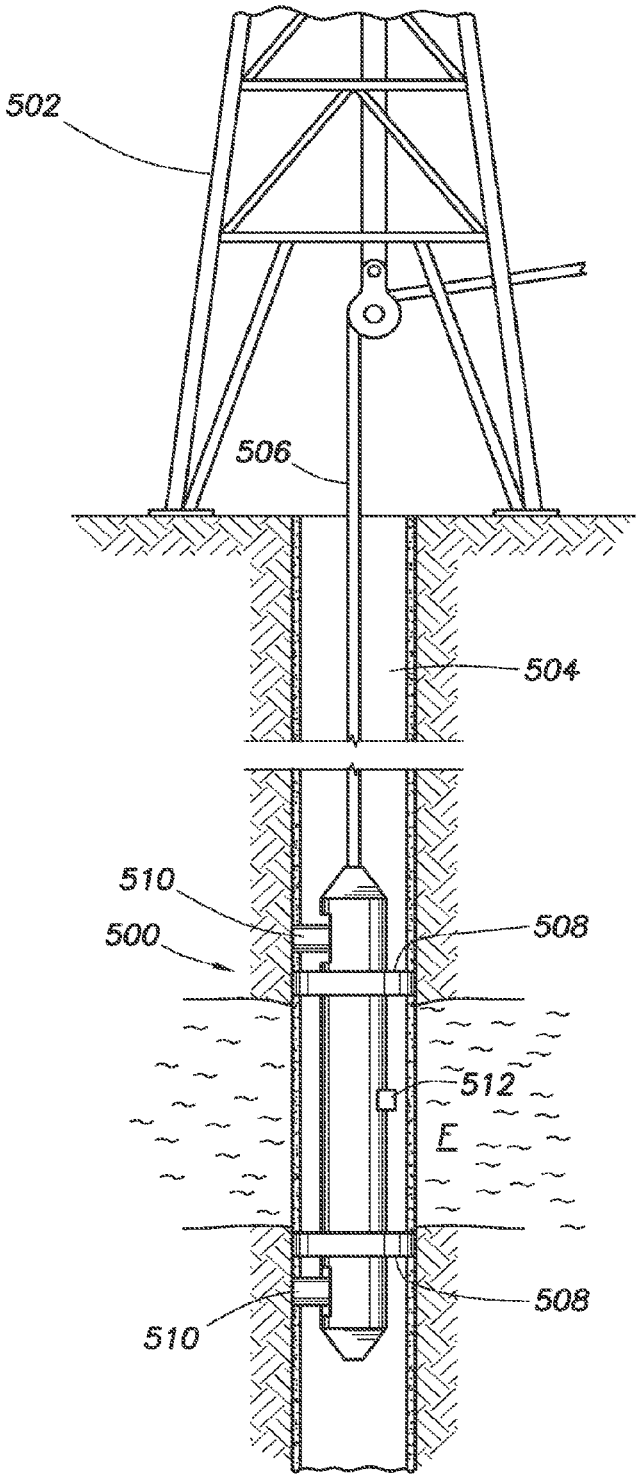
FIG. 4 is a schematic view of apparatus according to one or more aspects of the present disclosure.

Referring to FIG. 4, illustrated is a side schematic view of another wellsite having a tool 500 in accordance with one or more aspects of the present disclosure. Similar to that shown in FIG. 3, the tool 500 may be suspended within a wellbore 504 formed within a subterranean formation F using a multi-conductor cable 506. The multi-conductor cable 506 may be supported by a drilling rig 502.

As shown, the tool 500 may include one or more packers 508 that may be configured to inflate, thereby selectively sealing off a portion of the wellbore 504 for the tool 500. To test the formation F, the tool 500 may include one or more probes 510, and the tool 500 may also include one or more outlets 512 that may be used to inject fluids from a sample chamber and into the sealed portion established by the packers 508 between the tool 500 and the formation F and consequently within the formation F.

As such, the tool 500 may comprise a carrier module according to one or more aspects of the present disclosure. The sample chamber may be disposed in the carrier module. A piston may be disposed in the sample chamber, the piston defining a first chamber and a second chamber within the sample chamber. The sample chamber may comprise a first fluid port fluidly coupled to the first chamber, and a second fluid port fluidly coupled to the second chamber. The carrier module may comprise a flow regulator fluidly coupled to at least one of the first fluid port and the second fluid port.

Figure 5:
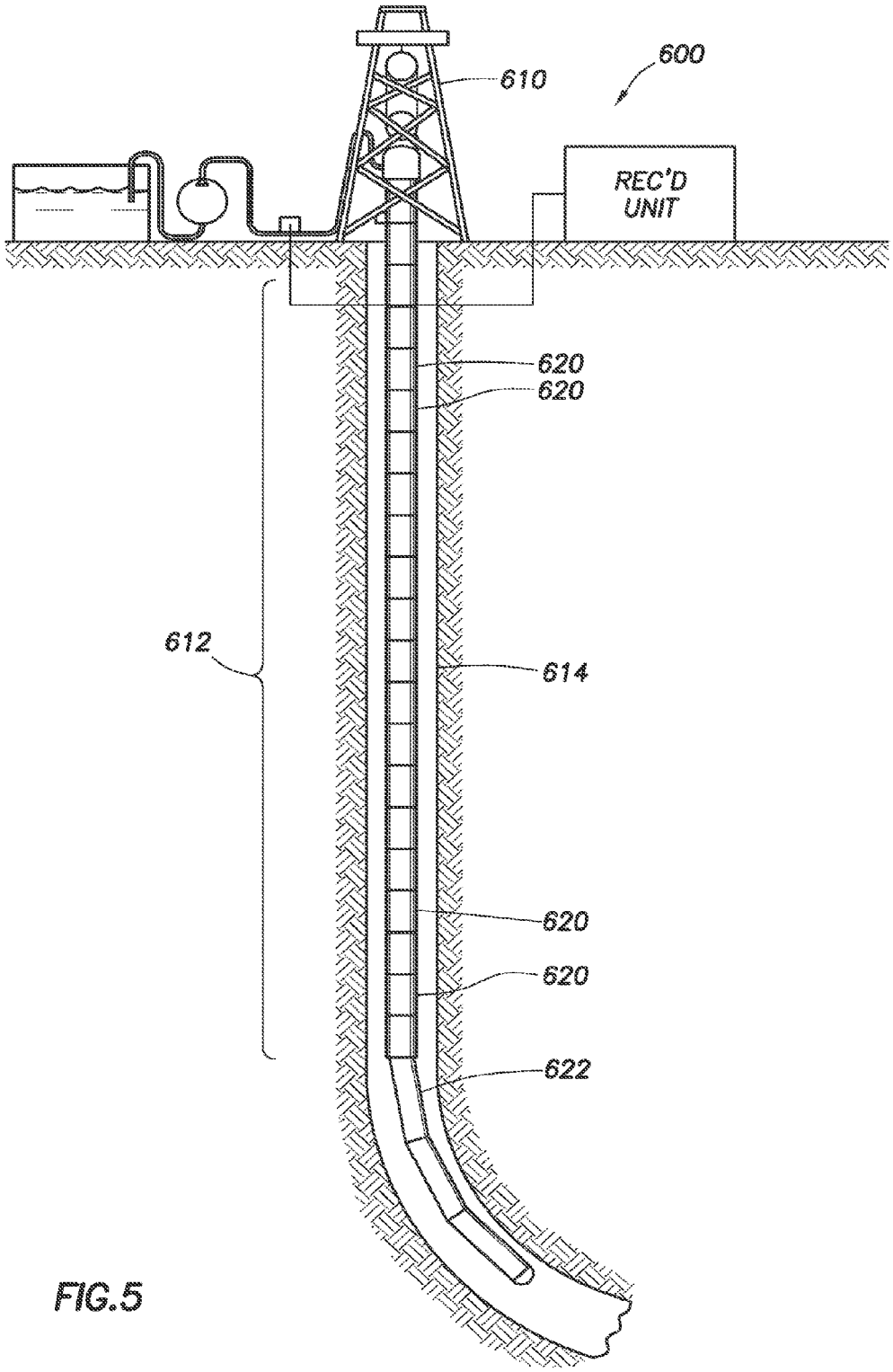
FIG. 5 is a schematic view of apparatus according to one or more aspects of the present disclosure.

Referring to FIG. 5, illustrated is a schematic view of a wellsite 600 having a drilling rig 610 in accordance with one or more aspects of the present disclosure. A wellbore 614 may be formed within a subterranean formation F, such as by using a drilling assembly, or any other method known in the art. A wired pipe string 612 may be suspended from the drilling rig 610. The wired pipe string 612 may be extended into the wellbore 614 by threadably coupling multiple segments 620 (i.e., joints) of wired drill pipe together in an end-to-end fashion. As such, the wired drill pipe segments 620 may be similar to that as described within U.S. Pat. No. 6,641,434, filed on May 31, 2002, entitled "Wired Pipe Joint with Current-Loop Inductive Couplers," and incorporated herein by reference.

Wired drill pipe may be structurally similar to that of typical drill pipe. However, the wired drill pipe may additionally include a cable installed therein to enable communication through the wired drill pipe. The cable installed within the wired drill pipe may be any type of cable capable of transmitting data and/or signals therethrough, such an electrically conductive wire, a coaxial cable, an optical fiber cable, and or any other cable known in the art. The wired drill pipe may include having a form of signal coupling, such as having inductive coupling, to communicate data and/or signals between adjacent pipe segments assembled together.

As such, the wired pipe string 612 may include one or more tools 622 and/or instruments disposed within the pipe string 612. For example, as shown in FIG. 5, a string of multiple wellbore tools 622 may be coupled to a lower end of the wired pipe string 612. The tools 622 may include one or more tools used within wireline applications, may include one or more LWD tools, may include one or more formation evaluation or sampling tools, and/or may include any other tools capable of measuring a characteristic of the formation F.

The tools 622 may be connected to the wired pipe string 612 during drilling the wellbore 614, or, if desired, the tools 622 may be installed after drilling the wellbore 614. If installed after drilling the wellbore 614, the wired pipe string 612 may be brought to the surface to install the tools 622, or, alternatively, the tools 622 may be connected or positioned within the wired pipe string 612 using other methods, such as by pumping or otherwise moving the tools 622 down the wired pipe string 612 while still within the wellbore 614. The tools 622 may then be positioned within the wellbore 614, as desired, through the selective movement of the wired pipe string 612, in which the tools 622 may gather measurements and data. These measurements and data from the tools 622 may then be transmitted to the surface of the wellbore 614 using the cable within the wired drill pipe 612.

According to one or more aspects of the present disclosure, at least one of the tools 622 may comprise a carrier module having a sample chamber for conveying an injection fluid into the wellbore 614. A piston may be disposed in the sample chamber, the piston defining a first chamber and a second chamber within the sample chamber. The sample chamber may comprise a first fluid port fluidly coupled to the first chamber, and a second fluid port fluidly coupled to the second chamber. The carrier module may comprise a flow regulator fluidly coupled to at least one of the first fluid port and the second fluid port. The at least one of the tools 622 may be used to inject fluid from the sample chamber into the formation F as described herein.

As such, apparatus according to one or more aspects of the present disclosure may be included within one or more of the aspects shown in FIGS. 1-5, in addition to being included within other tools and/or devices that may be disposed downhole within a formation within the scope of the present disclosure. Such apparatus may include a sample chamber configured to convey an injection fluid into a wellbore penetrating a subterranean formation. The sample chamber may hold an injection fluid such as surfactants, $CO_2$, diesel, proppants, and/or other gases, liquids, or liquids containing particulate matter and combinations thereof. Such apparatus may be used to inject the injection fluid into a subterranean formation.

Apparatus in accordance with one or more aspects of the present disclosure may include a carrier module which may house a sample chamber. The sample chamber may be divided into at least two chambers, with a first chamber holding an injection fluid having a first pressure and a second chamber that may be filled with a different fluid (such as a drive fluid) having a second pressure. The sample chamber may be divided by a piston. The piston may be a floating or free-floating piston that may fluidly separate the first and second chambers. A flow line may be configured to fluidly couple with a subterranean formation and may be employed to allow the injection fluid conveyed downhole in the first chamber to be injected into the formation. Further, a fluid source may be provided to be in selective fluid communication with the second chamber having the second pressure. The second pressure may be greater than the first pressure.

Apparatus in accordance with one or more aspects of the present disclosure may also include one or more flow regulators. The flow regulators may be configured to regulate a flow of injection fluid from the first chamber through the flow line and into the formation. For example, a seal valve may be provided to allow and/or prevent injection fluid to flow to and/or from the sample chamber. The seal valve may be selectively operable, allowing control over the flow of injection fluid to and/or from the sample chamber. Flow regulators may additionally or alternatively comprise a pair of valves that may be provided in parallel. The pair of valves may allow a safety control over the flow of injection fluid to and/or from the sample chamber, such as when filling the chamber and/or injecting into a downhole formation. The pair of valves may include a check valve and a pressure relief valve. The valves may be placed on and/or within the flow line, fluidly coupled to a fluid port exiting the sample chamber, and/or within the sample chamber. For example, the valves may be located within the first chamber. The flow from the sample chamber may flow out of the first chamber of the sample chamber through a fluid port, interact with the pair of valves in parallel (the check valve and the relief valve), and then pass through the seal valve. As used herein, a fluid port may be an inlet, an outlet, and/or may be configurable to be either an inlet or an outlet.

Alternatively and/or in combination with the above described valves, additional valves may be provided that may regulate the flow of fluid between a fluid source and the second chamber. For example, the fluid source may be the wellbore, including drilling fluids and/or muds, or may be a source of fluid provided from other chambers or sources on the surface, within the downhole tool, and/or within other downhole tools.

Wellbore fluid or mud, as well as other fluids, may be allowed to enter the second chamber of the sample chamber, in which the fluids may pressurize the first chamber of the sample chamber. For example, establishing a pressure communication between the second chamber and the wellbore may allow for hydrostatic pressure to be applied to the back side of the piston of the sample chamber. This may facilitate injecting fluid into the formation from the first chamber. Additionally, as noted above, flow regulators such as valves may be provided to control the flow of fluid from the wellbore into the second chamber.

Accordingly, in one or more aspects of the present disclosure, the fluid in the second chamber may provide pressure to the piston of the sample chamber so as to urge fluid out of the first chamber. The fluid entering the second chamber may be mud from the wellbore, drilling fluid, fluid provided from within the downhole tool, and/or any other fluid that may be used to apply pressure within the second chamber. The fluid may enter the second chamber through a second fluid port which may be part of and/or connected to a flow line. For example, a fluid port may be provided on the exterior of the downhole tool and connected to the second chamber by a flow line that may allow for mud from the wellbore to enter the second chamber. Alternatively, an injection pump may be used to urge a fluid provided from within the downhole tool or other fluid source into the second chamber.

If the pressure provided to the back side of the piston is too high, the piston may be actuated rapidly, forcing the fluid within the sample chamber to be expelled at a high rate. The fluid may flow uncontrollably from the sample chamber through the injection system and into the formation. Therefore, it may be desired to control the fluid flow from the sample chamber into the formation. Alternatively, or in combination, it may be desired to control the fluid flow from a fluid source into the second chamber.

Accordingly, in accordance with one or more aspects of the present disclosure, a check valve and a relief valve may provide for a control over the potential uncontrollable flow of fluid. The fluid or mud on the back side of the piston may be allowed to provide hydrostatic pressure. However, the fluid coming out of the first chamber may drop in pressure due to the relief valve. The drop in pressure of the injection fluid (the fluid from the first chamber) may be an amount equal to the pressure required to open the relief valve. Accordingly, the pressure of the injection fluid may be reduced by the operation of the relief valve. The pressure rating of the relief valve may be sufficiently high so as to prevent the flow of fluid from the sample chamber without the assistance of a fluid pump, such as may be provided in the injection system. A check valve may be provided in parallel with the relief valve so as to allow for easy filling of the sample chamber and may also provide for a safety control on the apparatus.

As noted above, mud or other fluid may be allowed to enter the second chamber of the sample chamber to provide hydrostatic pressure to prevent a high pressure differential in the apparatus. It may be the case that the mud or other fluid may be needed to provide force to operate the piston within the sample chamber. In this respect, the mud or other fluid may be a drive fluid.

The second chamber of the sample chamber may be fluidly coupled to the wellbore, allowing wellbore fluids to enter the second chamber and apply pressure to the piston of the sample chamber. However, the drive fluid may be provided from within the downhole tool, including additional sample chambers, or from other downhole tools, or provided from the wellsite surface. Accordingly, the drive fluid may be provided from any fluid source.

To provide drive fluid to the second chamber of the sample chamber from within the downhole tool, fluid may need to be provided from a flow line. As the first chamber may be connected to the flow line, the addition of a drive fluid to the flow line may cause contamination and/or mixing of the injection fluid with the drive fluid. Accordingly, the flow line may be modified to allow for the injection fluids and drive fluids to flow through the flow line without contamination and/or mixing.

The first chamber, with the injection fluid, may be fluidly coupled to a first section of the flow line. The second chamber, which may be fluidly coupled to a fluid source, may be fluidly coupled to a second section of the flow line. The flow line may be separated into the first section and the second section by a divider. The divider may be a plug, a lee plug, a weld, a valve, and/or any other static and/or operable fluid barrier. The divider may allow for fluid communication between the first chamber and the first section of flow line and the second chamber and the second section of flow line, respectively, without the problem of contamination and/or mixing of the fluids that may flow through the sections of the flow line.

Figure 6:
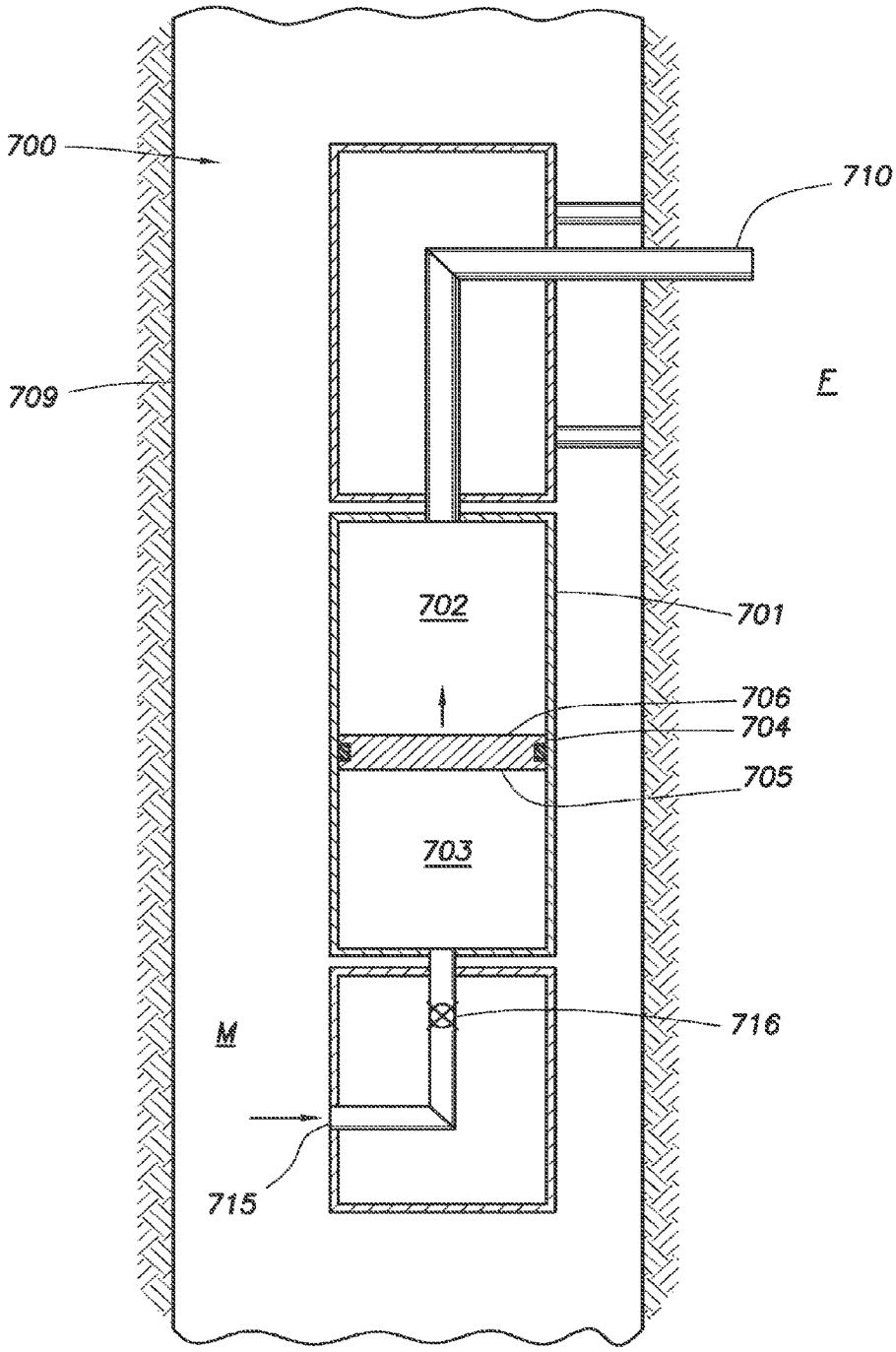
FIG. 6 is a schematic view of apparatus according to one or more aspects of the present disclosure.

Referring to FIG. 6, illustrated is an apparatus in accordance with one or more aspects of the present disclosure. The apparatus may comprise a downhole tool 700 that may be disposed in a wellbore 709, and may be included within one or more of the apparatus shown in FIGS. 1-5, in addition to being included within other tools and/or devices that may be disposed downhole within a subterranean formation within the scope of the present disclosure. The downhole tool 700 may be a single component or may be part of a more complex downhole tool or tool string. As shown, for example, the downhole tool 700 may include three sections. However, those skilled in the art will appreciate that the carrier module 700 may be made of more or fewer sections. The downhole tool 700 may include a sample chamber 701. The sample chamber 701 may include a first chamber 702 and a second chamber 703. The first chamber 702 may be separated from the second chamber 703 by a piston 704. The piston 704 may be a floating piston; however, those skilled in the art will appreciate that the piston 704 may be a mechanically operated piston or other piston known in the art.

The piston 704 may be moveable within the sample chamber 701. The piston 704 may be moved by fluid pressure applied on either side of the piston. Accordingly, a high pressure may be applied to a bottom surface 705 of the piston 704 from the second chamber 703, and may tend to push the piston 704 in an upward direction, as shown by the arrows of FIG. 6. Alternatively, a low pressure may be present in the second chamber 703, which may allow for a downward movement of the piston 704. Similarly, a high pressure may be present on a top surface 706 of the piston 704 in the first chamber 702, which may tend to push the piston 704 in a downward direction, contra to the arrows of FIG. 6. Alternatively, a low pressure may be present in the first chamber 702, which may allow for an upward movement of the piston 704 within the sample chamber 701.

The sample chamber 701 may be configured to hold an injection fluid that may be held in the first chamber 702. The injection fluid may be injected into a subterranean formation F, for example for the purpose of studying the formation F. The injection fluid held within the first chamber 702 may have a first pressure. The injection fluid may be injected and/or filled into the first chamber 702 at the wellsite surface, prior to disposing the downhole tool into a wellbore. Alternatively, a fluid may be provided to the first chamber 702 through a flow line or other fluid source within the downhole tool or from a fluid source at the surface. The injection fluid held within the first chamber 702 may be injected into the formation F through an injection tool 710. Injection tool 710 may include pumps, valves, controls, flow lines, nozzles, and/or any other combination of instruments or tools to inject fluid into the formation F.

The second chamber 703 may be filled with a drive, or "working," fluid, which may be different from the injection fluid in the first chamber 702 and may be at a second pressure. The drive fluid may provide a driving pressure and/or a differential pressure across the sample chamber 701. For example, the second chamber 703 may be filled with drilling mud or fluid M from the wellbore 709. The fluid M may enter the second chamber through a fluid port 715 that may be controlled by a regulator 716. The regulator 716 may include a pressure relief valve, a manually controlled needle valve, a choke, a pump system, and/or other fluid flow regulators. Alternatively, or in combination with that described above, fluid may also be provided to the second chamber 703 from a fluid source (not shown). The fluid source may be a second sample chamber, a reservoir, and/or other fluid holding container, or may be a fluid source from the surface of the wellsite. The fluid source may store and/or provide fluids, such as liquids, gases, and/or formation fluid samples at the second pressure.

Figure 7A:
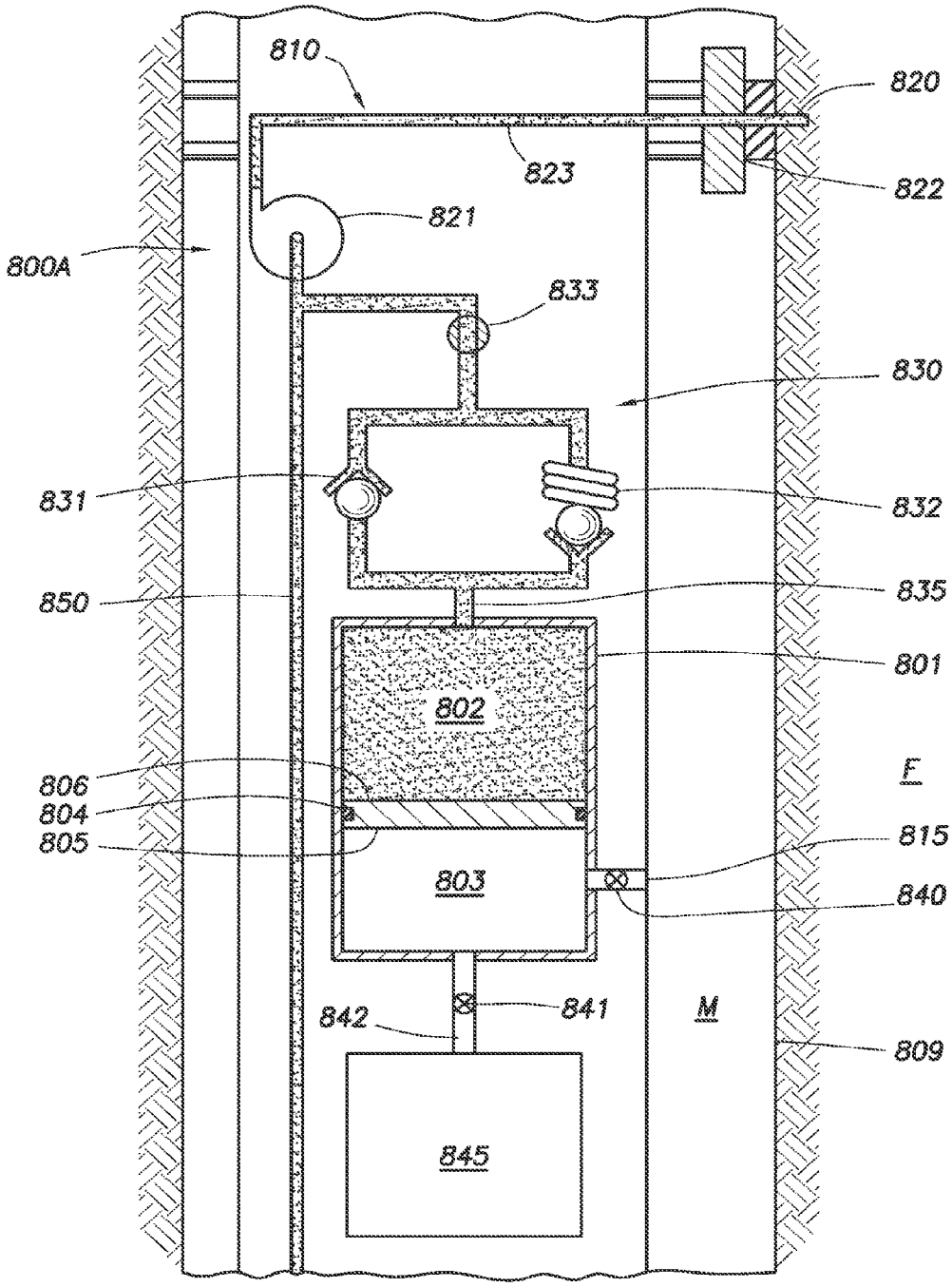
FIGS. 7A-7E are schematic views of apparatuses according to one or more aspects of the present disclosure.

Referring to FIG. 7A, illustrated is an apparatus in accordance with one or more aspects of the present disclosure. A downhole tool 800A may be part of the apparatus, which as described above, may be included within one or more of the apparatus shown in FIGS. 1-5, in addition to being included within other tools and/or devices that may be disposed downhole within a subterranean formation. The downhole tool 800A may have a sample chamber 801. The sample chamber 801 may be divided into two chambers, a first chamber 802, which may hold an injection fluid at a first pressure, and a second chamber 803, which may hold a drive fluid at a second pressure. The first chamber 802 and the second chamber 803 may be divided by a piston 804 having a top surface 806 and a bottom surface 805. As described above, a fluid in the second chamber 803 may apply pressure to the bottom surface 805 of the piston 804 and a fluid in the first chamber 802 may apply pressure to the top surface 806 of the piston 804.

Fluid may enter the second chamber 803 by a fluid port 815. The fluid port 815 may be fluidly coupled to a wellbore 809, which may contain mud and/or wellbore fluids M. The fluid port 815 may be fluidly controlled by a flow regulator, such as valve system 840 or other similar control. As described above, the apparatus may be configured to inject an injection fluid contained in the first chamber 802 into a formation F. Accordingly, the apparatus may include an injection tool or system 810. The injection system 810 may include an injection probe 820, a reciprocating pump 821, an extension mechanism 822, an injection line 823, and/or any other injection tools or equipment. The injection fluid held within the sample chamber 801, and specifically the first chamber 802, may be injected into the formation F at least in part by operation of the injection system 810. The downhole tool 800A may include a flow line 850 that may allow for fluid communication with the wellsite surface, with the wellbore, and/or with other downhole tools and/or instruments.

Although shown with fluid entering the second chamber 803 from the wellbore, those skilled in the art will appreciate that fluid may be provided to the second chamber 803 from any fluid source including additional sample chambers and/or reservoirs, without departing from the scope of the present disclosure.

For example, as shown in FIG. 7A a fluid source 845, such as a second sample chamber, a fluid reservoir and/or pump, may be provided in downhole tool 800A, or may be provided in another downhole tool. The fluid source 845 may hold a drive fluid at a second pressure, different from the pressure of the injection fluid held in first chamber 802. The fluid source 845 may be connected to the second chamber 803 by a flow line 842. Flow line 842 may have a flow regulator 841 that may allow for controlled operation of the fluid flowing from the fluid source 845 into the second chamber 803.

Fluid pressure and fluid flow within the apparatus may be controlled by a flow regulator, such as a system of valves 830. An injection fluid may flow from the first chamber 802 through a flow line 835, and into valve system 830. The valve system 830 may include a seal valve 833 which may be placed between the sample chamber 801 and the injection system 810. The seal valve 833 may allow for control by a tool operator over fluid flow out of and/or into the sample chamber 801. The valve system 830 may include a pair of valves that may be placed in parallel to assist in control over the fluid flow and pressure within the apparatus. A check valve 831 may be provided to allow for filling of the first chamber 802 with an injection fluid. The check valve 831 may also allow for a safety control on the apparatus. A relief valve 832 may be provided in parallel with the check valve 831. The relief valve 832 may have a pressure rating. The relief valve 832 may allow for a reduction of the fluid pressure across the relief valve. The reduction of the fluid pressure may essentially be equal to the rating of the relief valve 832. Accordingly, the fluid pressure of a fluid coming from the first chamber 802 may be reduced by an amount essentially equal to the pressure rating of the relief valve 832, thereby allowing for a more controlled flow of fluid from the first chamber 802 to the injection system 810 and into the formation F.

Although the above system is shown with a check valve 831 and a relief valve 832 installed in parallel with each other, and in fluid communication between seal valve 833 and first chamber 802, those skilled in the art will appreciate that the check valve 831 may not be necessary for the relief valve 832 to function as a control on the fluid pressure coming from the first chamber 802. Accordingly, the relief valve 832 may be the only valve that controls the flow of fluid as the fluid exits the first chamber 802. Without the check valve 831, filling the first chamber 802 with the injection fluid may need to be provided through some other means and/or mechanism. Accordingly, a separate fluid port (not shown) may be provided to the first chamber 802 to allow fluid to enter the first chamber 802.

Those skilled in the art will appreciate that the flow regulators 840 and/ 841 may be implemented using the valve system 830. Thus, the valve system 830 may be located between the fluid source 845 and the second chamber 803, thereby regulating the flow of fluid into the second chamber 803, without departing from the scope of the present disclosure. Also, the valve system 830 may be located between the wellbore 809 and the second chamber 803, thereby regulating the flow of wellbore fluid M into the second chamber 803, without departing from the scope of the present disclosure. These alternate configurations permit isolating the flow regulator from the injection fluid. Isolating the flow regulator from the injection fluid may be advantageous in cases where the injection fluid is corrosive and may corrode portions of the flow regulator.

Although the relief valve 832 and the check valve 831 are shown in FIG. 7A as outside of the sample chamber 801, it should be understood that the valve system or regulator 830 (one or both of the relief valve 832 and the check valve 831) may be located within the sample chamber 801. A stop (not shown) may be added to the sample chamber 801 to prevent the piston 804 from contacting and/or damaging a valve or other object that may be located within the sample chamber 801.

Figure 7B:
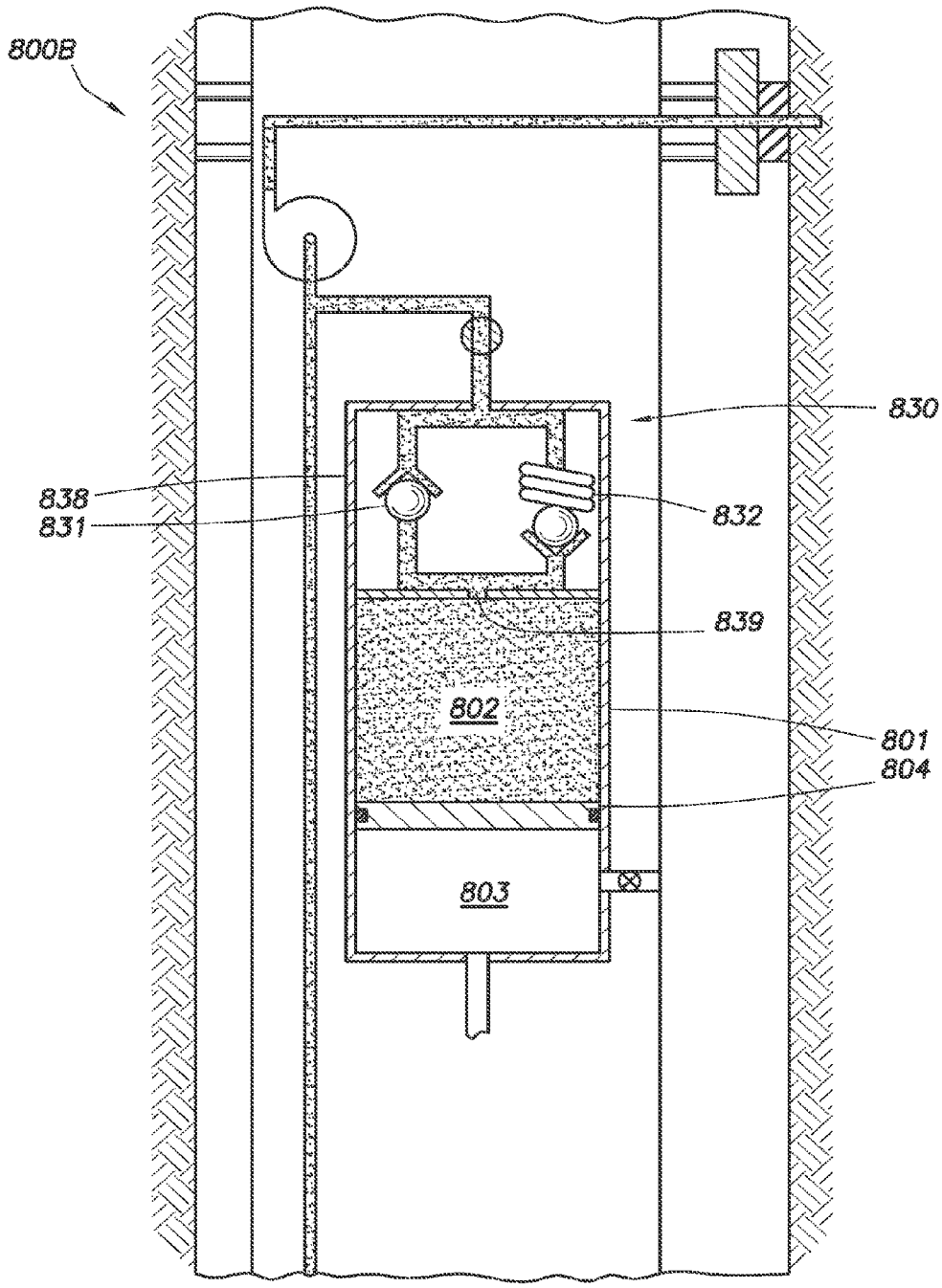

Referring to FIG. 7B, illustrated is an apparatus in accordance with one or more aspects of the present disclosure. Similar to the downhole tool 800A, the downhole tool 800B may have an injection system and flow lines as discussed above. However, as shown in FIG. 7B, the valve system 830 may be incorporated into and/or part of the sample chamber 801. Accordingly, the valve system 830 may be installed in an upper portion 838 of the sample chamber 801. The valve system 830 may include a relief valve 832 and a check valve 831, as described above. A drive fluid may be provided to second chamber 803, as discussed above. The pressure applied to a piston 804 within sample chamber 801 may force an injection fluid from first chamber 802 through a fluid port 839 and into the top portion 838 of sample chamber 801 containing the valve system 830.

Figure 7C:
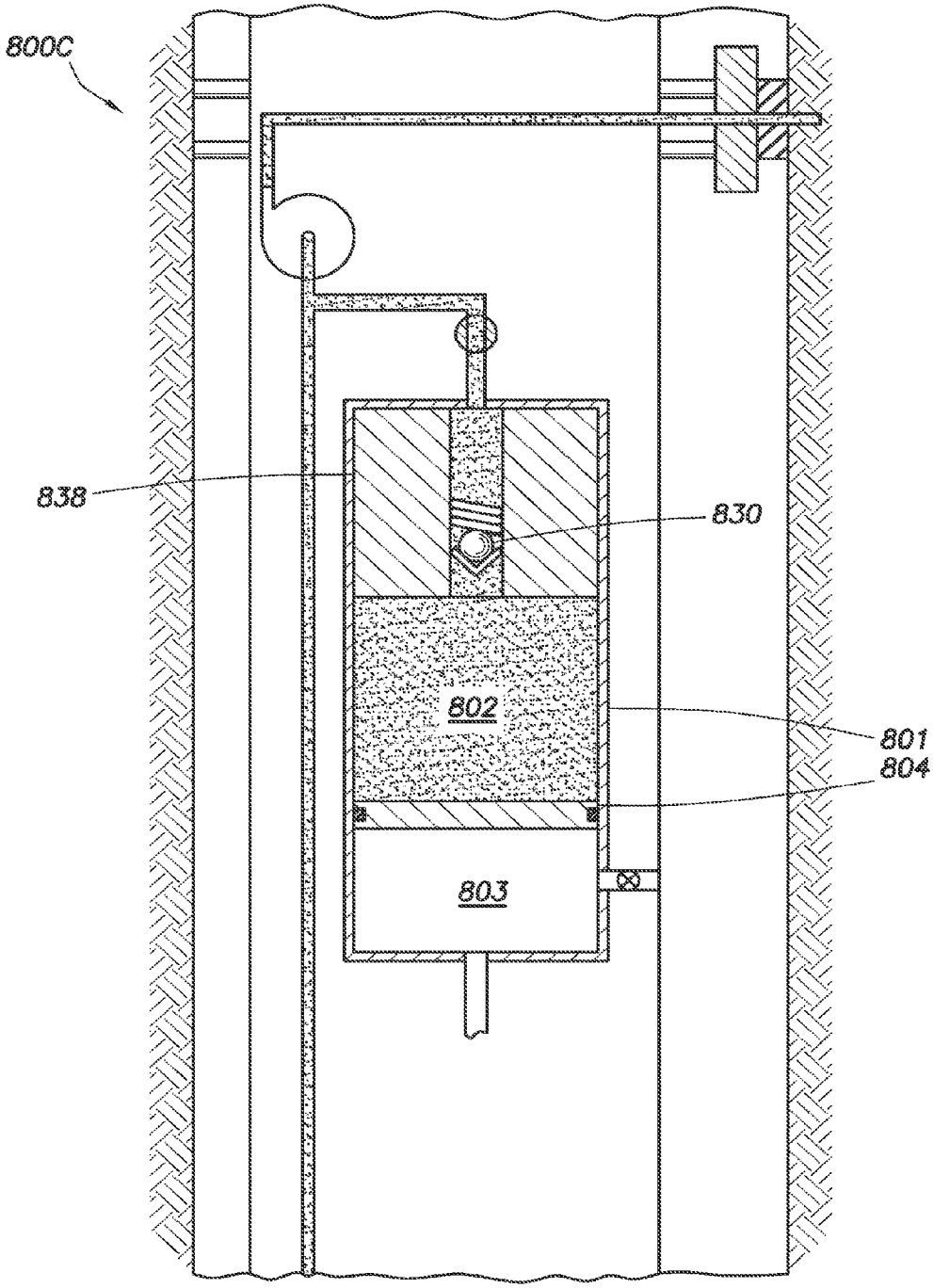

Referring to FIG. 7C, illustrated is an apparatus in accordance with one or more aspects of the present disclosure. Similar to that discussed above, the carrier module 800C may have an injection system, flow lines, and/or other components. As illustrated in FIG. 7C, a valve system 830 may be installed such that fluid may flow from the first chamber 802 directly into the valve system 830. The valve system 830 may be installed in an upper portion 838 of the sample chamber 801 and may include a relief valve, a check valve, and/or other valves and/or combinations thereof. A drive fluid within second chamber 803 may force a piston 804 to force an injection fluid within first chamber 802 to pass through and fluidly interact with the valve system 830. The upper portion 838 of sample chamber 801 may be configured such that the piston 804 may not damage the valve system 830 during actuation of the piston.

Figure 7D:
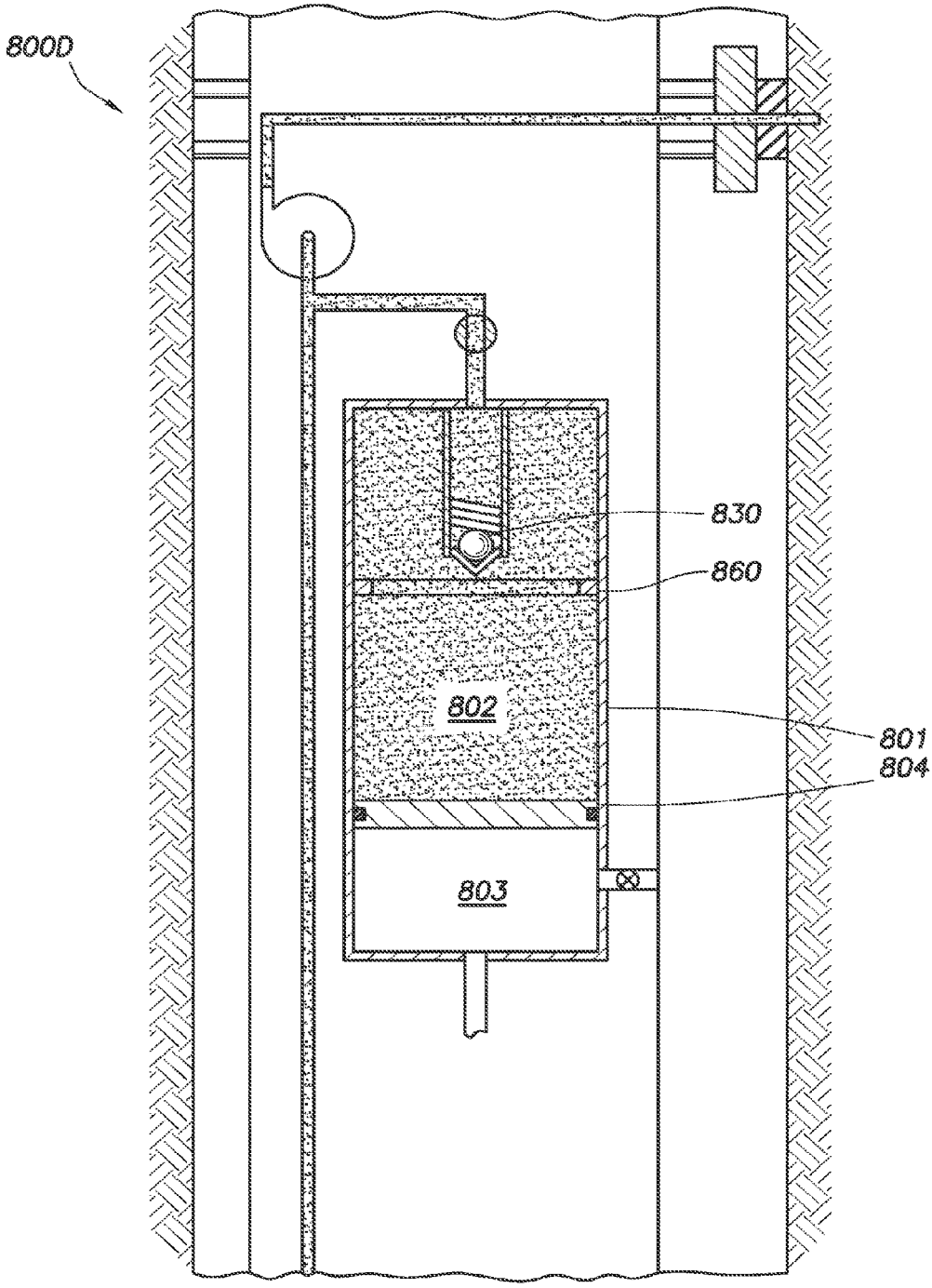

Referring to FIG. 7D, illustrated is an apparatus in accordance with one or more aspects of the present disclosure. Similar to that discussed above, the carrier module 800D may have an injection system, flow lines, and/or other components. Again, a valve system 830 may be installed within sample chamber 801. A drive fluid within second chamber 803 may force a piston 804 to actuate and force an injection fluid within the first chamber 803 to pass through and/or interact with the valve system 830. As illustrated in FIG. 7D, a ring or other form of stopper 860 may be provided within sample chamber 801 that may prevent the piston 804 from damaging the valve system 830 during actuation of the piston 804.

Figure 7E:
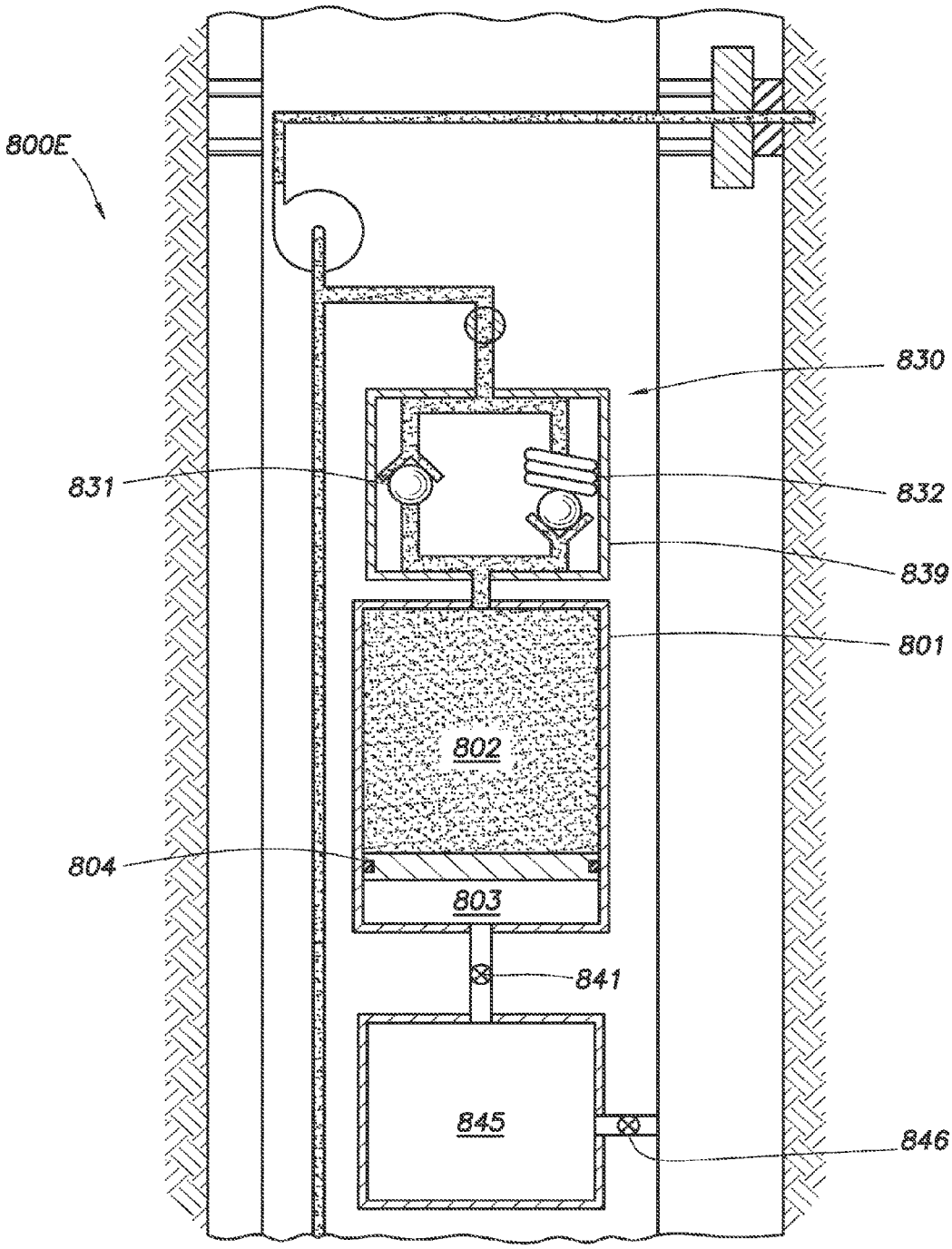

Referring to FIG. 7E, illustrated is an apparatus in accordance with one or more aspects of the present disclosure. Similar to that discussed above, the carrier module 800E may have an injection system, flow lines, and/or other components. As illustrated in FIG. 7E, a valve system 830 may be contained within a detachable module 839. Accordingly, a first sample chamber 801 may include an injection fluid in a first chamber 802, thereof. A drive fluid may be provided from a second sample chamber 845 into the second chamber 803 of first sample chamber 801 through a valve and/or flow line 841. The drive fluid may be contained within the second sample chamber 845 or the drive fluid may be provided from other fluid sources, such as drilling fluids and/or muds from the wellbore, through a valve and/or valve system and/or a fluid port 846. The second chamber 803 and/or the second sample chamber 845 may be configured to store a formation fluid sample and comprising a gas or liquid at the second pressure.

As a piston 804 within first sample chamber 801 may be actuated by pressure provided from the drive fluid, an injection fluid stored within the first sample chamber 801 may be forced through a flow line into the detachable module 839, which may house the valve system 830. Valve system 830 may include a relief valve 832 and/or a check valve 831, and/or other valves as described above.

Figure 8:
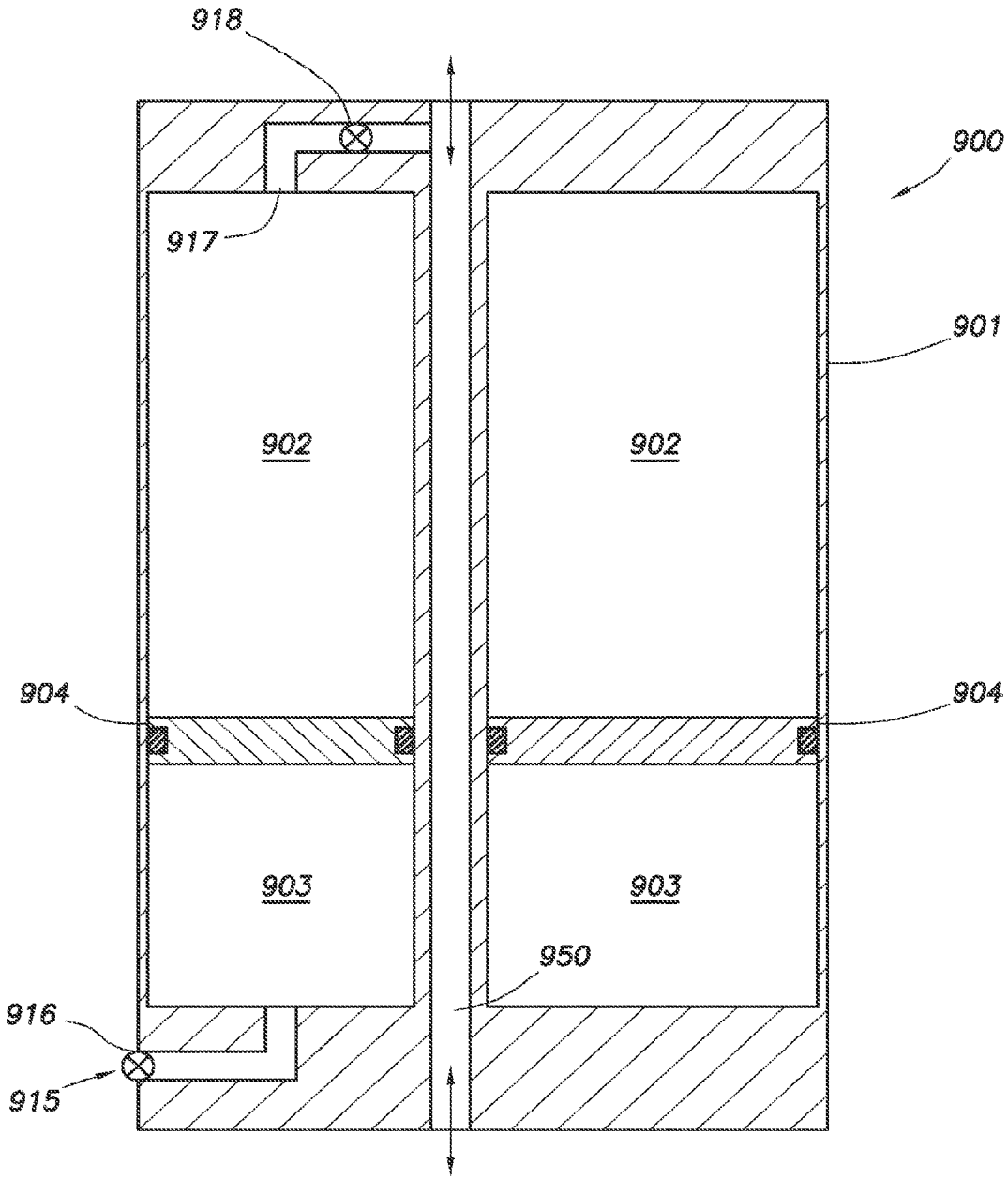
FIG. 8 is a schematic view of apparatus according to one or more aspects of the present disclosure.

Referring to FIG. 8, illustrated is an apparatus in accordance with one or more aspects of the present disclosure. FIG. 8 shows a cross-sectional schematic of a carrier module 900. The carrier module 900 may include a sample chamber 901 that may be configured to hold an injection fluid to be injected into a formation (not shown) by an injection system (not shown). The sample chamber 901 may be divided into two chambers, a first chamber 902 that may hold the injection fluid at a first pressure, and/or a second chamber 903 that may hold a drive fluid at a second pressure. Alternatively, the drive fluid may be held in a fluid source at the second pressure, and provided to the second chamber 903 through a flowline or other fluid communicating means. The first chamber 902 may be separated from the second chamber 903, for example, by a piston 904, such as a floating piston.

The injection fluid held in the first chamber 902 may be configured to flow through a flow line 950 of the carrier module 900. The injection fluid may be conveyed through a fluid port 917, which may be controlled by a regulator 918, and into the flow line 950. The fluid port 917 may be a fluid outlet that may allow fluid to exit first chamber 902. The regulator 918 may be a pressure relief valve, a seal valve controlled by a tool operator, a choke and/or any combination thereof.

Fluid entering and/or exiting the second chamber 903 may enter and/or exit through a fluid port 915. The fluid port 915 may be a fluid inlet that may allow for fluid to enter the second chamber 903. The fluid port 915 may be controlled by a regulator 916. The regulator 916 may be a pressure relief valve, a seal valve controlled by a tool operator, a choke and/or any combination thereof. Fluid port 915 may be fluidly coupled to the wellbore, which may allow wellbore fluids to enter the second chamber 903.

Figure 9:
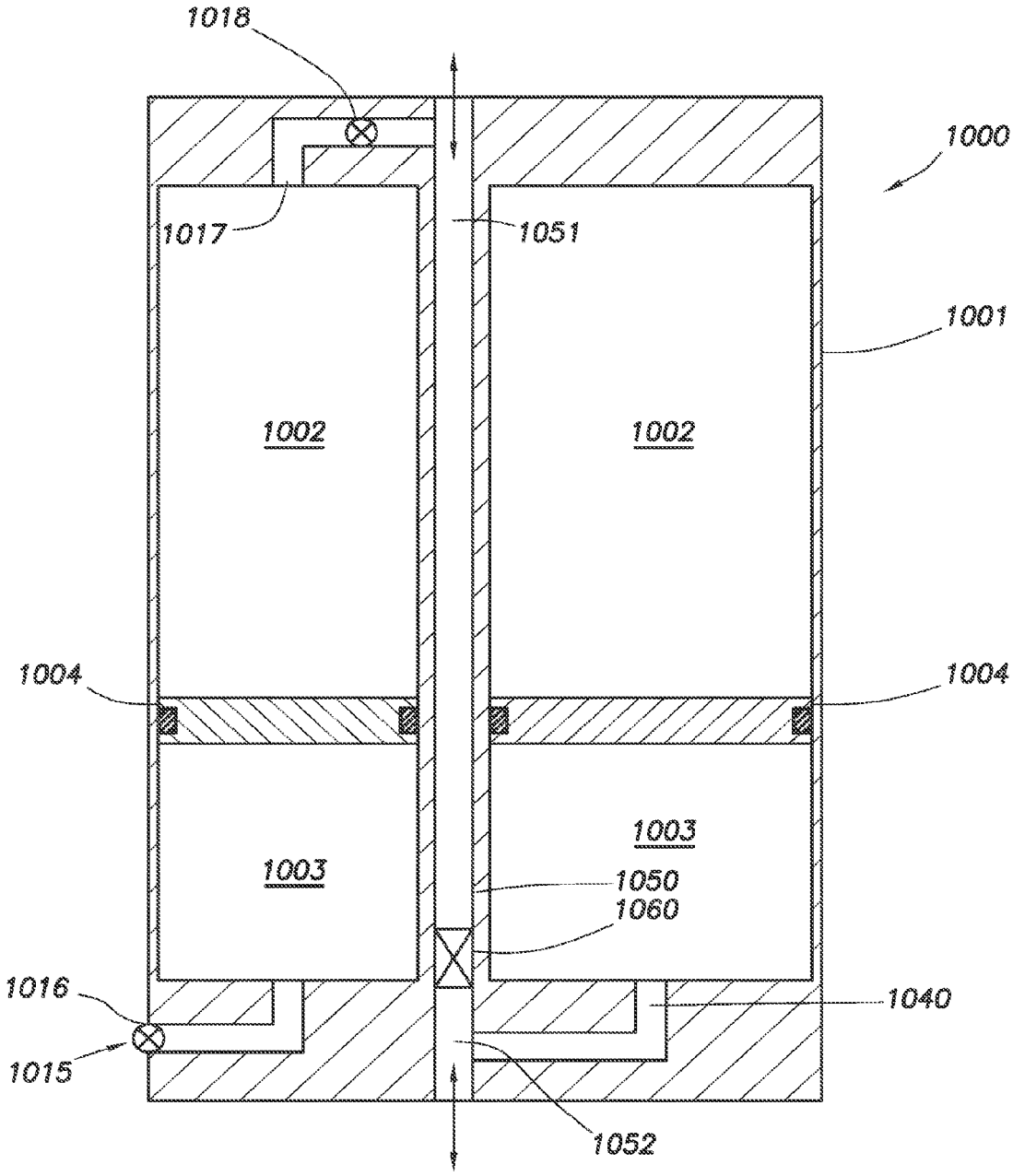
FIG. 9 is a schematic view of apparatus according to one or more aspects of the present disclosure.

Referring to FIG. 9, illustrated is an apparatus in accordance with one or more aspects of the present disclosure. FIG. 9 shows a cross-sectional schematic of a carrier module 1000. The schematic drawing of the carrier module 1000 may be similar to that of the carrier module 900 of FIG. 8.

The carrier module 1000 may include a sample chamber 1001 with a first chamber 1002 and a second chamber 1003. A piston 1004 may divide the first chamber 1002 from the second chamber 1003. The first chamber 1002 may be fluidly coupled to a flow line 1050 by a fluid port 1017 (such as a fluid outlet), which may be controlled by regulator 1018. The second chamber 1003 may be fluidly coupled with a wellbore by a fluid port 1015 (such as a fluid inlet), that may be controlled by a regulator 1016 and may also be fluidly coupled to the flow line 1050 by a fluid port 1040 (such as a fluid inlet).

The flow line 1050 may be divided by a divider 1060 such that a first section of the flow line 1051 and a second section of the flow line 1052 may be formed. Additionally, the divider 1060 may prevent contamination or mixing of the fluids that may flow in to or out of the first chamber 1002 and the second chamber 1003, respectively. The divider 1060 may be implemented with a lee plug, a weld, and/or any other fluid seal and/or stop known in the art.

The second chamber 1003 may have more than one fluid port, which may provide fluid, such as a drive fluid, to the second chamber 1003. As noted above, a fluid port 1015 may be fluidly coupled with a wellbore, which may allow for wellbore fluid or mud to flow through the fluid port 1015.

The second chamber 1003 may also be fluidly coupled to the flow line 1050 through a fluid port 1040. This may allow for fluid to be provided to the second chamber 1003 from some source other than the wellbore, such as from the wellsite surface and/or from other instruments and/or downhole tools. For example, fluid port 1040 may be fluidly coupled via the flow line 1050 to a fluid source that may hold and/or provide a gas or liquid that may be used as a drive fluid. The fluid source may comprise a second sample chamber, a reservoir, a pump system, and/or any other fluid holding device or mechanism. The flow of fluid through the section 1052 of the flow line 150 may be controlled by a flow regulator.

Figure 10:
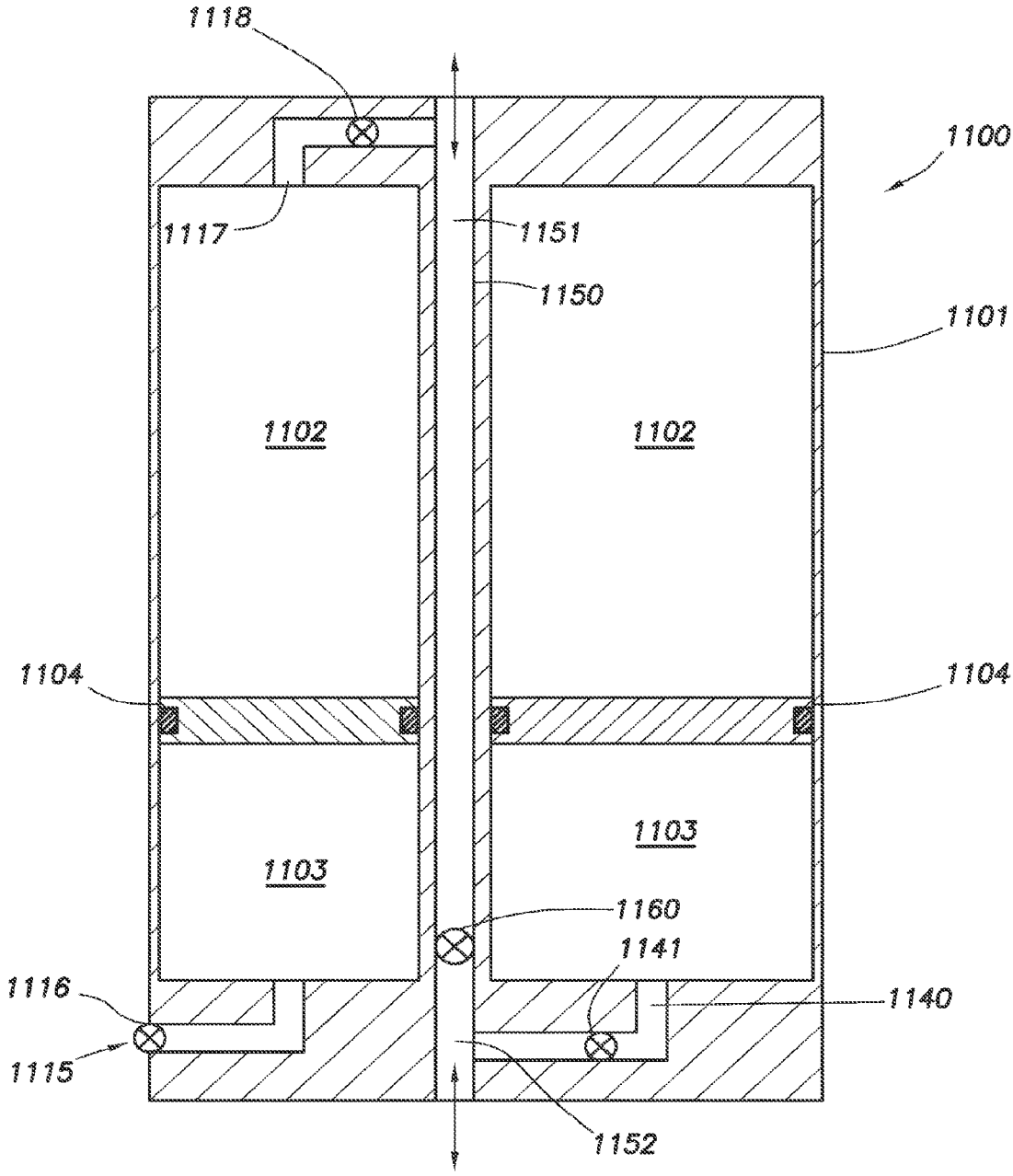
FIG. 10 is a schematic view of apparatus according to one or more aspects of the present disclosure.

Referring to FIG. 10, illustrated is an apparatus in accordance with one or more aspects of the present disclosure. FIG. 10 shows a cross-sectional schematic of a carrier module 1100. The schematic drawing of the carrier module 1100 may be substantially similar to that of the carrier module 1000 of FIG. 9 and/or the carrier module 900 of FIG. 8.

The carrier module 1100 may include a sample chamber 1101 with a first chamber 1102 and a second chamber 1103. A piston 1104 may divide the first chamber 1102 from the second chamber 1103. The first chamber 1102 may be fluidly coupled to a flow line 1150 by a fluid port 1117 (such as a fluid outlet) that may be controlled by regulator 1118. The second chamber 1103 may be fluidly coupled with a wellbore by a fluid port 1115 (such as a fluid inlet) that may be controlled by a regulator 1116, or may be fluidly coupled to a fluid source, such as another sample chamber and/or reservoir. The second chamber 1103 may be fluidly coupled to the flow line 1150 by a fluid port 1140 (such as a fluid inlet) that may be controlled by a regulator 1141. The flow line 1150 may be divided by a selectively operable divider 1160 to form a first section of the flow line 1151 and a second section of the flow line 1152.

The selectively operable divider 1160 may be a seal valve or other fluid control device or method known in the art. Fluid port 1140, which may fluidly couple the second chamber 1103 with the flow line 1150, may be controlled by regulator 1141. Regulator 1141 may be a pressure relief valve, a seal valve controlled by a tool operator, a choke and/or any combination thereof.

Aspects of the present disclosure may include elements of the embodiments disclosed in FIGS. 1-10. Accordingly, flow regulators such as valve systems as described in FIGS. 6, and 7A through 7E may be included in the carrier modules described in FIGS. 8 through 10. Conversely, carrier modules as described in FIGS. 8 through 10 may be used to implement at least a portion of the downhole tools described FIGS. 6 and 7A through 7E. Embodiments disclosed herein may provide for one or more of the following advantages. An apparatus and method in accordance with the present disclosure may be included within one or more of the tools shown in FIGS. 1-5, in addition to being included within other tools and/or devices that may be disposed downhole within a formation. An apparatus and a method in accordance with one or more aspects of the present disclosure may provide control of the flow of a fluid that may be injected into a formation.

In view of all of the above and the figures, those skilled in the art should readily recognize that the present disclosure introduces an apparatus, comprising: a downhole tool configured for conveyance within a wellbore extending into a subterranean formation, the downhole tool comprising: a sample chamber configured to store a formation fluid sample and comprising a piston defining a first chamber and a second chamber, wherein the first chamber comprises an injection fluid having a first pressure, and wherein the second chamber is in selective fluid communication with a fluid source having a second pressure that is greater than the first pressure; a flow line configured to provide fluid communication between the formation and the first chamber; and a flow regulator configured to regulate fluid flow from the first chamber to the formation in response to selective fluid communication between the fluid source and the second chamber. The flow regulator may comprise a relief valve. The flow regulator may be disposed within the first chamber. The flow regulator may be configured to transmit fluid between the sample chamber and the flow line. The flow regulator may be configured to transmit fluid between the second chamber and the fluid source. The fluid source may comprise wellbore fluid at the second pressure communicated from the wellbore. The fluid source may be an additional sample chamber configured to store a formation fluid sample and may comprise a gas or liquid at the second pressure. The fluid source may comprise a reservoir comprising a gas or liquid at the second pressure. The apparatus may further comprise a check valve configured to transmit fluid from the flow line to the first chamber. The apparatus may further comprise a seal valve configured to selectively transmit fluid between the flow line and the first chamber. The apparatus may further comprise a pump configured to pump the injection fluid from the first chamber into the formation. The apparatus may further comprise a pump configured to pump wellbore fluid from the wellbore into the second chamber.

The present disclosure also introduces a method, comprising: conveying a downhole tool within a wellbore extending into a subterranean formation, the downhole tool comprising: a sample chamber configured to store a formation fluid sample and comprising a piston defining a first chamber and a second chamber, wherein the first chamber comprises an injection fluid having a first pressure, and wherein the second chamber is in selective fluid communication with a fluid source having a second pressure that is greater than the first pressure; a flow line configured to provide fluid communication between the formation and the first chamber; and a flow regulator configured to regulate fluid flow from the first chamber to the formation in response to selective fluid communication between the fluid source and the second chamber; establishing fluid communication between the formation and the flow line; and injecting the injection fluid into the formation via the flow regulator and the flow line. Injecting the injection fluid into the formation may comprise transmitting the injection fluid from the first chamber, through the flow regulator and the flow line, and into the formation. Injecting the injection fluid into the formation may comprise transmitting fluid from the fluid source to the second chamber via the flow regulator. The fluid source may comprise wellbore fluid at the second pressure communicated from the wellbore. The fluid source may be an additional sample chamber configured to store a formation fluid sample and comprising a gas or liquid at the second pressure. The fluid source may comprise a reservoir comprising a gas or liquid at the second pressure. Injecting the injection fluid into the formation may comprise opening a seal valve configured to selectively transmit fluid between the flow line and the first chamber. Injecting the injection fluid into the formation may comprise at least one of: pumping the injection fluid from the first chamber into the formation; and pumping wellbore fluid from the wellbore into the second chamber.

The foregoing outlines feature several embodiments so that those skilled in the art may better understand the aspects of the present disclosure. Those skilled in the art should appreciate that they may readily use the present disclosure as a basis for designing or modifying other processes and structures for carrying out the same purposes and/or achieving the same advantages of the embodiments introduced herein. Those skilled in the art should also realize that such equivalent constructions do not depart from the spirit and scope of the present disclosure, and that they may make various changes, substitutions and alterations herein without departing from the spirit and scope of the present disclosure.

The Abstract at the end of this disclosure is provided to comply with 37 C.F.R. §1.72(b) to allow the reader to quickly ascertain the nature of the technical disclosure. It is submitted with the understanding that it will not be used to interpret or limit the scope or meaning of the claims.

What is claimed is:

1. An apparatus, comprising:

a downhole tool configured for conveyance within a wellbore extending into a subterranean formation, the downhole tool comprising:

a sample chamber configured to store a formation fluid sample and comprising a piston defining a first chamber and a second chamber, wherein the first chamber comprises an injection fluid having a first pressure, and wherein the second chamber is in selective fluid communication with a fluid source having a second pressure that is greater than the first pressure;

a flow line configured to provide fluid communication between the formation and the first chamber; and a valve system disposed within the sample chamber and in fluid communication with the flow line between the first chamber and the formation and comprising:

a first valve configured to regulate flow of the injection fluid from the first chamber to the formation in response to selective fluid communication between the fluid source and the second chamber; and a second valve disposed in parallel with the first valve and configured to permit the injection fluid to flow into the first chamber; wherein the valve system is disposed within a separate portion of the sample chamber from the first chamber and the second chamber, and wherein movement of the piston directs the injection fluid through a fluid port into the separate portion.

2. The apparatus of claim 1 wherein the first valve comprises a relief valve.

3. The apparatus of claim 1 wherein the first valve is configured to transmit fluid between the sample chamber and the flow line.

4. The apparatus of claim 1 wherein the fluid source comprises wellbore fluid at the second pressure communicated from the wellbore.

5. The apparatus of claim 1 wherein the fluid source comprises a reservoir comprising a gas or liquid at the second pressure.

6. The apparatus of claim 1 wherein the second valve comprises a check valve configured to transmit fluid from the flow line to the first chamber.

7. The apparatus of claim 1 further comprising a seal valve configured to selectively transmit fluid between the flow line and the first chamber via the first valve and the second valve.

8. The apparatus of claim 1 further comprising a pump configured to pump the injection fluid from the first chamber into the formation.

9. The apparatus of claim 1 further comprising a pump configured to pump wellbore fluid from the wellbore into the second chamber.

10. A method, comprising:

conveying a downhole tool within a wellbore extending into a subterranean formation, the downhole tool comprising:

a sample chamber configured to store a formation fluid sample and comprising a piston defining a first chamber and a second chamber, wherein the first chamber comprises an injection fluid having a first pressure, and wherein the second chamber is in selective fluid communication with a fluid source having a second pressure that is greater than the first pressure;

a flow line configured to provide fluid communication between the formation and the first chamber; and a valve system disposed within the sample chamber and in fluid communication with the flow line between the first chamber and the formation and comprising:

a first valve configured to regulate flow of the injection fluid from the first chamber to the formation in response to selective fluid communication between the fluid source and the second chamber; and a second valve disposed in parallel with the first valve and configured to permit the injection fluid to flow into the first chamber;

establishing fluid communication between the formation and the flow line; and injecting the injection fluid into the formation via the flow regulator and the flow line, wherein injecting the fluid into the formation comprises applying pressure to the piston via the fluid source to direct the injection fluid through a fluid port in the sample chamber to an upper portion of the sample chamber housing the first valve and the second valve.

11. The method of claim 10 wherein injecting the injection fluid into the formation comprises transmitting the injection fluid from the first chamber, through the first valve and the flow line, and into the formation.

12. The method of claim 10 wherein the fluid source comprises wellbore fluid at the second pressure communicated from the wellbore.

13. The method of claim 10 wherein the fluid source comprises a reservoir comprising a gas or liquid at the second pressure.

14. The method of claim 10 wherein injecting the injection fluid into the formation comprises opening a seal valve configured to selectively transmit fluid between the flow line and the first chamber via the first valve and the second valve.

15. The method of claim 10 wherein injecting the injection fluid into the formation comprises at least one of:

pumping the injection fluid from the first chamber into the formation; and pumping wellbore fluid from the wellbore into the second chamber.

16. The method of claim 10 comprising injecting the injection fluid into the first chamber through the second valve.

* * * * *